US009656458B2

(12) United States Patent
Ikeda

(10) Patent No.: US 9,656,458 B2
(45) Date of Patent: May 23, 2017

(54) PRINTING DEVICE

(71) Applicant: MIMAKI ENGINEERING CO., LTD., Nagano (JP)

(72) Inventor: Akira Ikeda, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/421,842

(22) PCT Filed: Aug. 23, 2013

(86) PCT No.: PCT/JP2013/072517
§ 371 (c)(1),
(2) Date: Feb. 16, 2015

(87) PCT Pub. No.: WO2014/034544
PCT Pub. Date: Mar. 6, 2014

(65) Prior Publication Data

US 2015/0217563 A1 Aug. 6, 2015

(30) Foreign Application Priority Data

Aug. 27, 2012 (JP) ..... 2012-186915

(51) Int. Cl.
*B41J 11/00* (2006.01)
*B41M 5/52* (2006.01)
(Continued)

(52) U.S. Cl.
CPC ..... *B41J 2/0057* (2013.01); *B41J 11/06* (2013.01); *B41J 13/10* (2013.01); *B65H 1/06* (2013.01);
(Continued)

(58) Field of Classification Search
CPC ..... B41J 11/007; B41M 5/52
(Continued)

(56) References Cited

U.S. PATENT DOCUMENTS 4,759,282 A * 7/1988 Talmadge ..... 101/35
5,786,835 A * 7/1998 Ikeda et al. ..... 347/106
(Continued)

FOREIGN PATENT DOCUMENTS

CN 1116990 2/1996
JP 5-186014 7/1993
(Continued)

OTHER PUBLICATIONS

"International Search Report (Form PCT/ISA/210)", mailed on Sep. 24, 2013, with English translation thereof, pp. 1-2, in which three of the listed references (JP2002-154247, JP10-53332 and JP5-186014) were cited.
(Continued)

*Primary Examiner* — Bradley Thies
(74) *Attorney, Agent, or Firm* — Jianq Chyun IP Office

(57) ABSTRACT

A printing device that can continuously print on a plurality of recording media even if a user is not beside the printing device over a long period of time is provided. The printing device includes a tray storing container (10) that installs a plurality of trays (20) on which mount media (100) are mounted, and a transfer section (30) that takes out one tray (20) among the plurality of trays (20) from the tray storing container (10), and transfers the same to a printing region (R1) facing a surface for discharging ink in a head (40).

10 Claims, 2 Drawing Sheets

(51) Int. Cl.

| | |
|---|---|
| ***B41J 2/005*** | (2006.01) |
| ***B41J 11/06*** | (2006.01) |
| ***B41J 13/10*** | (2006.01) |
| ***B65H 1/06*** | (2006.01) |
| ***B65H 3/24*** | (2006.01) |
| ***B65H 5/02*** | (2006.01) |
| ***B65H 29/38*** | (2006.01) |

(52) U.S. Cl.
CPC ..... *B65H 3/24* (2013.01); *B65H 5/021* (2013.01); *B65H 29/38* (2013.01); *B65H 2404/23* (2013.01); *B65H 2404/242* (2013.01); *B65H 2405/332* (2013.01); *B65H 2405/36* (2013.01); *B65H 2701/174* (2013.01)

(58) Field of Classification Search
USPC ..... 347/101, 104
See application file for complete search history.

(56) References Cited

U.S. PATENT DOCUMENTS

| | | | | |
|---|---|---|---|---|
| 6,045,318 | A * | 4/2000 | Mochida et al. | 414/609 |
| 8,528,717 | B2 * | 9/2013 | Ando et al. | 198/345.3 |
| 8,579,286 | B2 * | 11/2013 | Hirai et al. | 271/265.01 |
| 8,919,950 | B2 * | 12/2014 | Veis | 347/104 |
| 2004/0179081 | A1 * | 9/2004 | Nimi | B41J 2/01 347/104 |
| 2007/0068403 | A1 * | 3/2007 | Fresener et al. | 101/115 |
| 2007/0194034 | A1 * | 8/2007 | Vasiadis | 221/21 |
| 2009/0056567 | A1 | 3/2009 | Ando et al. | |
| 2009/0060696 | A1 | 3/2009 | Ando et al. | |

FOREIGN PATENT DOCUMENTS

| | | |
|---|---|---|
| JP | 10-53332 | 2/1998 |
| JP | 2002-154247 | 5/2002 |
| JP | 2009-56655 | 3/2009 |
| KR | 100197038 | 6/1999 |
| KR | 20090023027 | 3/2009 |
| WO | WO 2012108870 A1 * | 8/2012 |

OTHER PUBLICATIONS

"1st Office Action of China Counterpart Application", with English translation thereof, issued on Nov. 27, 2015, p. 1-p. 15.
"Office Action of Japan Counterpart Application", issued on Jan. 12, 2016, pp. 1-8, with English translation thereof.
"Office Action of Korea Counterpart Application" with English translation, issued on Apr. 20, 2016, p. 1-p. 8, in which the isted references were cited.
"Office Action of China Counterpart Application" with English translation, issued on Jul. 25, 2016, p. 1-p. 17, in which the listed reference was cited.
"Office Action of European Counterpart Application", issued on Jun. 15, 2016, p. 1-p. 7, in which the listed reference was cited.

* cited by examiner

PRINTING DEVICE

CROSS-REFERENCE TO RELATED APPLICATION

This application is a 371 application of the International PCT application serial no. PCT/JP2013/072517, filed on Aug. 23, 2013, which claims priority benefits of Japan Patent Application No. 2012-186915 filed on Aug. 27, 2012. The entirety of each of the above-mentioned patent applications is hereby incorporated by references herein and made a part of this specification.

TECHNICAL FIELD

The present invention relates to a printing device.

BACKGROUND ART

Patent Document 1 describes a printing device for sequentially performing a plurality of processing operations on a print target object.

PRIOR ART DOCUMENT

Patent Document

Patent Document 1: JP 2009-56655 A (published on Mar. 19, 2009)

SUMMARY OF THE INVENTION

Problems to be Solved by the Invention

However, in the printing device described in Patent Document 1, pallets on which print target objects are mounted need to be installed in the printing device sequentially by manual operation; therefore, a user cannot leave the printing device unattended.

The present invention is an invention that has been made in view of such a circumstance, and provides a printing device that can continuously print on a plurality of recording media even if a user is not beside the printing device over a long period of time.

Solutions to the Problems

A printing device according to the present invention includes: a recording medium installing section that installs a plurality of mounting equipment on which recording media are mounted; and a transfer means that takes out one mounting equipment among the plurality of mounting equipment from the recording medium installing section, and transfers the one mounting equipment to a printing region that faces a surface for discharging ink in a head for discharging the ink relative to a recording medium.

If the plurality of mounting equipment is installed in advance, printing can be performed by sequentially transferring each of the mounting equipment automatically to the printing region. That is, by suitably installing a plurality of mounting equipment by loading a desired number of recording media thereon, the user can leave the printing device unattended until the printing on all of the recording media is finished. Thus, the printing can be performed continuously on the plurality of recording media even if the user is not beside the printing device over a long period of time.

In the printing device according to the present invention, it is more preferable to further include a hand-over region that is at a position in a course of transfer from the recording medium installing section to the printing region by the transfer means, and that is a place to hand over the mounting equipment so as to mount the same on a mounting stand for mounting the mounting equipment.

The mounting equipment can be mounted on the mounting stand in the hand-over region. The mounting equipment mounted on the mounting stand is conveyed to the printing region, and printed.

In the printing device according to the present invention, it is more preferable to further include a preprocessing means that is at a position in the course of transfer from the recording medium installing section to the printing region by the transfer means, and that performs a pre-print processing on the recording medium.

Before being transferred to the printing region, the pre-print processing suitable for the printing to bring the recording medium to be in a state suitable for printing, such as cleaning, position adjustment, static electricity removal and the like on the recording medium can be performed.

In the printing device according to the present invention, it is more preferable that the preprocessing means includes a vertical position adjusting section that adjusts a position of the recording medium in a vertical direction.

Where the recording medium is displaced in the vertical direction, for example, by floating upward in the transfer by the transfer means, the position of the recording medium can be adjusted by the vertical position adjusting section. Thus, printing can be performed with even higher accuracy.

In the printing device according to the present invention, it is more preferable that the transfer means includes a toothed belt, and a gear that meshes with teeth of the toothed belt.

In the case of transferring over a long distance, the recording medium can be transferred faster. Especially in an embodiment being provided with a printed recording medium storage, a long distance from the recording medium installing section to the printed recording medium storage needs to be traveled. Since such a long distance travel can be performed at high speed, the printing can be performed in a shorter time.

In the printing device according to the present invention, it is more preferable that the transfer means further includes a mounting equipment moving section that moves the mounting equipment from inside to outside of the recording medium installing section.

The mounting equipment can more easily be moved onto the mounting stand.

In the printing device according to the present invention, it is more preferable to further include a positioning section that is on a downstream side in a transfer direction of the mounting equipment by the mounting equipment moving section, and that is for restricting a moving distance in the transfer direction.

By preventing positional displacement of the mounting equipment, the printing can be performed with even higher accuracy.

In the printing device according to the present invention, it is more preferable that the transfer means transfers the mounting equipment, on which a printed recording medium is mounted, to a printed recording medium storage that stores the mounting equipment.

Since the recording media are stored in the printed recording medium storing container, the user does not need to collect the printed recording media by hand.

In the printing device according to the present invention, it is more preferable to further include a post processing means that is at a position on a downstream side of the printing region as transferred by the transfer means, and that performs a post-print processing on the recording medium.

For example, by being provided with a doming device for over-coating and/or spray gun as the post processing means, various post-print processing such as a doming step and/or a spray gun step can be performed on the recording medium.

Effects of the Invention

According to the present invention, the advantageous effect of being able to print continuously on the plurality of recording media even if the user is not beside the printing device over a long period of time can be achieved.

EMBODIMENTS OF THE INVENTION

Configuration of Printing Device

Figure 1:
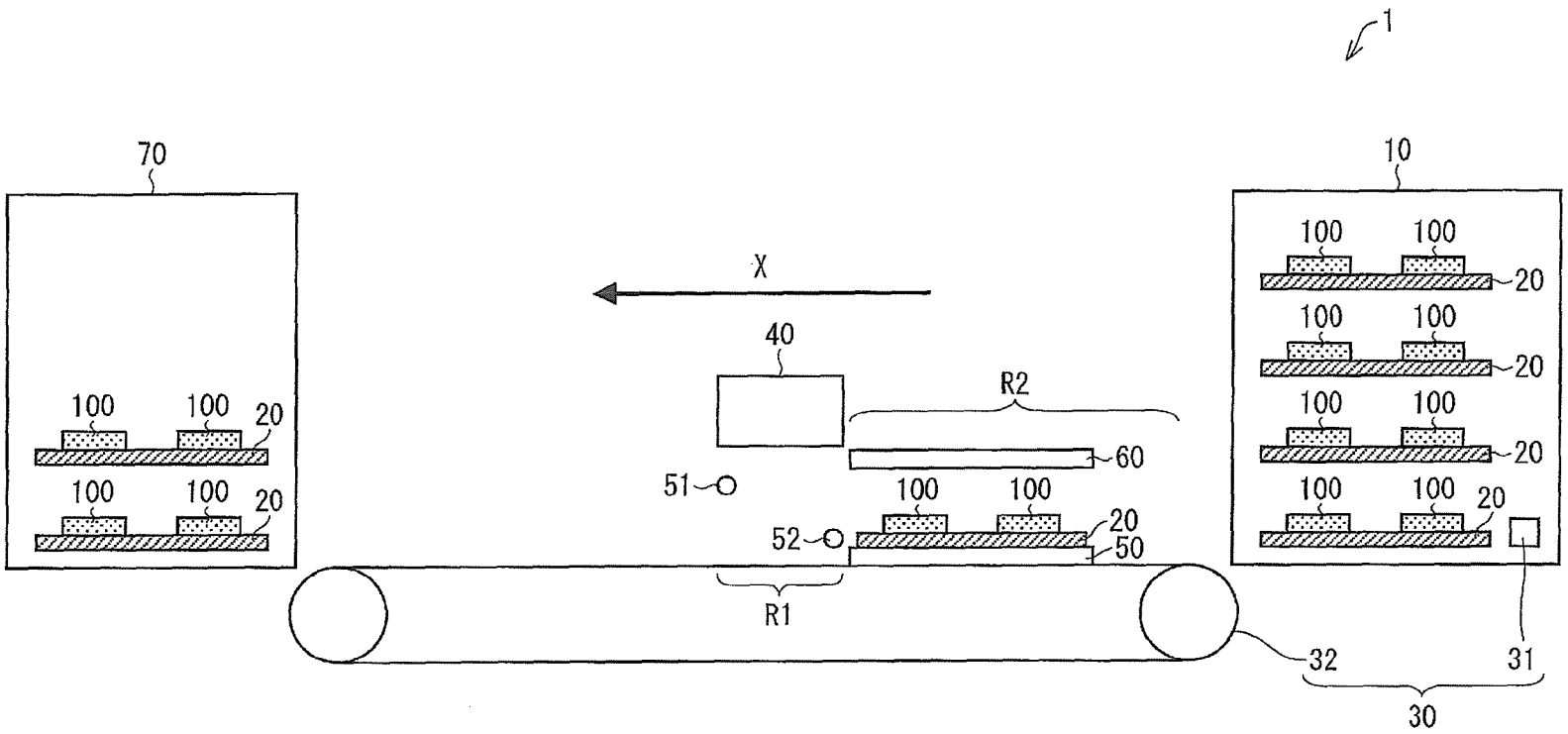
FIG. 1 is a diagram schematically showing a configuration of one embodiment of a printing device of the present invention.
Figure 2:
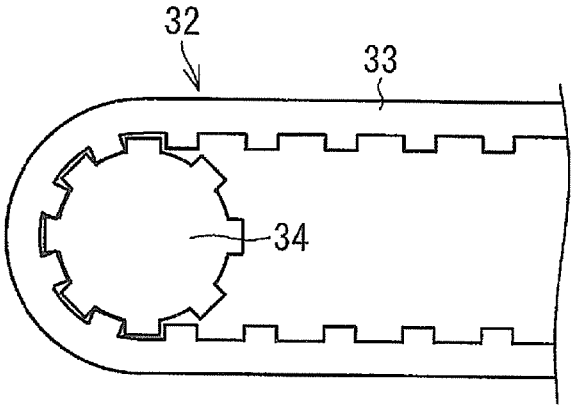
FIG. 2 is a diagram showing a configuration of a main part of a belt conveyor provided in one embodiment of the printing device of the present invention.

Herein below, embodiments of the present invention will be described in detail with reference to FIG. 1 and FIG. 2. FIG. 1 is a diagram schematically showing a configuration of a printing device 1 that is one embodiment of the printing device of the present invention. FIG. 2 is a diagram showing a configuration of a main part of a belt conveyor 32 provided in the printing device 1.

As shown in FIG. 1, the printing device 1 includes a tray storing container (recording medium installing section) 10, a transfer section (transfer means) 30, a head 40, a table (mounting stand) 50, an optical sensor 51, a contact pin (positioning section) 52, an acrylic plate (preprocessing means; vertical position adjusting section) 60, and a printed medium storing container (printed recording medium storage) 70.

The tray storing container 10 is for storing a plurality of trays (mounting equipment) 20 on each of which a plurality of media (recording media) 100 before printing is mounted in a manner of being arranged to align in a vertical direction.

Trays 20 are stored in the tray storing container 10 manually, however, a desired number of media 100 that need to be printed can be mounted on the trays 20, and a desired number of trays 20 can be installed in advance in the tray storing container 10. In the printing device 1, printing is performed by taking out a tray 20 sequentially from the tray storing container 10 in which the plurality of trays 20 is stored, and transferring the tray 20 to a printing region R1 that is a region facing an ink discharging surface of the head 40; therefore, the user does not need to set the trays 20 on the printing device 1 on one-by-one basis. Thus, the plurality of media 100 can be printed continuously even if the user is not beside the printing device 1 over a long period of time.

The tray storing container 10 includes a push-out section (mounting equipment moving section) 31. The push-out section 31 is a constituent member of the transfer section 30. The push-out section 31 pushes out the tray 20 in a direction of an arrow X. According to this, the tray 20 can be moved onto the table 50.

The tray storing container 10 may be configured to fix a position of the push-out section 31 while moving other members such as a housing and the like up and down in the vertical direction, so that the tray 20 being the target to be taken out from the tray storing container 10 and moved is brought to a position where it is pushed out by the push-out section 31. According to this, the plurality of trays 20 can sequentially be moved onto the table 50 in a smooth manner. It should be noted that, upon pushing out the tray 20 by the push-out section 31, the table 50 is preferably moved in a direction opposite to the direction of the arrow X, and be moved to a position where it can receive the tray 20.

The transfer section 30 is configured of the push-out section 31 and a belt conveyor 32.

The push-out section 31 is configured to push out the tray 20 in the direction of the arrow X from within the tray storing container 10.

The belt conveyor 32 is for transferring the table 50. According to this, the tray 20 is transferred from a hand-over region R2 to the printed medium storing container 70. It should be noted that, in the hand-over region R2, the tray 20 is mounted on the table 50. The hand-over region R2 is a region where the tray 20 pushed out by the push-out section 31 is placed when it comes out of the tray storing container 10, and the tray 20 is loaded on the table 50 by the tray 20 being pushed out when the table 50 is positioned in the hand-over region R2.

As shown in FIG. 2, the belt conveyor 32 is configured of a toothed belt 33, and a gear 34 that meshes with teeth of the toothed belt 33. Due to this configuration, the table 50 can be transferred faster. In the printing device 1, the tray 20 taken out from the tray storing container 10 needs to be transferred for a long distance to the printed medium storing container 70, and use of the belt conveyor 32 provided with the toothed belt 33 in such a device enables the transfer to take less time. Thus, the entire printing step can be completed in a shorter period of time. Further, due to being toothed, a positional displacement occurs less frequently, and printing with higher accuracy can be performed.

The head 40 is for discharging ink onto the media 100. A region that faces the surface for discharging the ink of the head 40, which in other words is a region in which the discharged ink can strike, is the printing region R1. The head 40 may be configured to scan above the tray 20, or may be configured to suitably move in the printing region R1 so that the ink discharged from the head 40 is received by the tray 20.

The table 50 is for mounting the tray 20. The table 50 is arranged on the belt conveyor 32. It is moved in the direction of the arrow X or in the opposite direction thereof in accordance with the drive of the belt conveyor 32.

The optical sensor 51 is for detecting positions of upper surfaces of the media 100. By detecting such a position, the media 100 can be arranged at a position suitable for printing by moving the table 50 up and down.

The contact pin 52 is positioned on a downstream side in a transfer direction of the tray 20 by the push-out section 31, and is a positioning member for restricting a moving distance in the transfer direction. The tray 20 that has been pushed out stops moving by the contact pin 52, whereby its position in the direction of the arrow X, that is, in the transfer direction is adjusted.

The acrylic plate 60 is for adjusting the positions of the media 100 in the vertical direction. For example, if the media 100 are displaced by being floated or the like upward in the vertical direction by an impact caused when the pushed out tray 20 contacts the contact pin 52, the displacement is corrected by pressing the same by the acrylic plate 60. Thus, printing can be performed with even higher accuracy. It should be noted that the vertical position adjusting section in the printing device according to the present invention is not limited to a plate-shaped member such as the acrylic plate, but will suffice so long as it can move the mounting equipment in the vertical direction.

Up and down movement of the acrylic plate 60 may be performed manually, however, it may be made to move up and down automatically by detecting the displacement by a sensor and the like. As a mechanism for furnishing the up and down movement, a cylinder that moves the acrylic plate 60 up and down by air pressure may be exemplified.

Further, the position adjustment in the vertical direction is an embodiment of the pre-print processing in the present invention. The pre-print processing in the present invention is not limited to the position adjustment, and for example, cleaning, static electricity removal and the like of the media may be exemplified.

The pre-print processing in the present embodiment is performed in the hand-over region R2. As above, if the pre-print processing is performed in the hand-over region R2, it is preferable in the aspect of saving space, however, the pre-print processing and the handover may be performed in different regions.

The printed medium storing container 70 is a container for storing the trays 20 on which the media 100 of which printing has been completed are mounted. The trays 20 transferred by the transfer section 30 are sequentially stored in the printed medium storing container 70.

As shown in FIG. 1, the stored trays 20 are arranged to align in the vertical direction. Due to this, the printed medium storing container 70 may move up and down in the vertical direction so that the trays 20 transferred from the belt conveyor 32 are stored in appropriate levels.

The printing device according to the present invention may include a post processing means that performs post-print processing on the recording media at a position on a downstream side of the printing region in the transfer direction, which in other words is a region on the downstream side of the printing region to be transferred by the transfer means. As the post processing means, a doming device for over-coating, and a spray gun can be exemplified. According to this, a doming step, a spray gun step, and the like can be performed.

Further, in the printing device according to the present invention, a function of an insertion work may be added. The insertion work means to provide different mounting equipment to the printing device for which printing, pre-print processing, post-print processing and the like are desired in the middle of performing a work by sequentially transferring mounting equipment. For example, the different mounting equipment may be mounted in the hand-over region and be collected after the pre-print processing, or be subjected to printing thereafter, and the different mounting equipment may be mounted in the region on the downstream side of the printing region in the transfer direction to subject it to the post-print processing, and the different mounting equipment that was inserted and printed may be collected.

(Operation of Printing Device)

Next, an operation of the printing device 1 will be described.

Firstly, the media 100 are mounted on the trays 20. The number of media 100 mounted on one tray 20 and the number of the trays 20 can suitably be set, in accordance with desired printing amount.

Next, the trays 20 are installed in the tray storing container 10. In the present embodiment, as shown in FIG. 1 the trays 20 are arranged so as to align in the vertical direction in the tray storing container 10.

Next, the printing device 1 is activated. Firstly, the printing device 1 drives the belt conveyor 32 to arrange the table 50 in the hand-over region R2.

Next, the push-out section 31 pushes out the tray 20 in the direction of the arrow X. According to this, the tray 20 is mounted on the table 50. At this time, the tray 20 moves forcefully until the tray 20 contacts the contact pin 52 by the pushing force of the push-out section 31. Further, the moving distance in the transfer direction is restricted by making contact with the contact pin 52, and the position in the transfer direction is thereby adjusted.

Next, if the media 100 on the tray 20 are displaced by being floated and the like in the vertical direction by the tray 20 colliding with the contact pin 52, the positions thereof are adjusted by pressing by the acrylic plate 60 to correct the displacement.

Next, the table 50 is transferred to the printing region R1. In the printing region R1 the optical sensor 51 detects the positions of the upper surfaces of the media 100. If the detected positions are positions not suitable for printing, the table 50 is moved up and down to perform positioning.

Next, the ink is discharged from the head 40 and the printing is performed on the media 100.

When the printing is completed, the table 50 is further transferred in the direction of the arrow X. In the transfer direction, the post-print processing such as the doming step and the spray gun step is performed as needed in the region downstream of the head 40 and upstream of the printed medium storing container 70.

Finally, the table 50 is transferred before the printed medium storing container 70, and the tray 20 is stored in the printed medium storing container 70. The printed medium storing container 70 may include a mechanism such as a roller or the like for winding up the tray 20 so as to collect the tray 20.

The present invention is not limited to the aforementioned respective embodiments, and can be modified variously within the scope defined in the claims, and embodiments obtained by suitably combining the technical means disclosed in different embodiments are also within the technical scope of the present invention.

(Supplementary Descriptions)

As above, the printing device 1 includes the tray storing container 10 that installs the plurality of trays 20 on which the media 100 are mounted, and the transfer section 30 that takes out one tray 20 among the plurality of trays 20 from the tray storing container 10, and transfers the same to the printing region R1 that faces the surface for discharging ink in the head 40 for discharging the ink relative to the media 100.

If the plurality of trays 20 is installed in advance, the printing can be performed by sequentially transferring each of the trays 20 automatically to the printing region R1. That is, by suitably loading the desired number of media 100 on the plurality of trays 20, the user can leave the printing device unattended until the printing on all of the media 100 is finished. Thus, the printing can be performed continuously on the plurality of media 100 even if the user is not beside the printing device 1 over a long period of time.

In the printing device 1, the hand-over region R2 being the place for mounting the tray 20 on the table 50 is provided at a position in the course of transfer from the tray storing container 10 to the printing region R1 by the transfer section 30.

The tray 20 can be mounted on the table 50 in the hand-over region R2. The tray 20 mounted on the table 50 is conveyed to the printing region R1, and printed.

In the printing device 1, it is more preferable to include a preprocessing means that is at a position in the course of transfer from the tray storing container 10 to the printing region R1 by the transfer section 30, and that performs the pre-print processing on the media 100.

Before being transferred to the printing region R1, the pre-print processing to bring the media 100 to be in the state suitable for printing, such as cleaning, position adjustment, static electricity removal and the like on the media 100 can be performed.

In the printing device 1, the preprocessing means is the acrylic plate 60 that adjusts the positions of the media 100 in the vertical direction.

Where the media 100 are displaced in the vertical direction, for example, by floating upward in the transfer by the transfer section 30, the positions of the media 100 can be adjusted by the acrylic plate 60. Thus, printing can be performed with even higher accuracy.

In the printing device 1, it is preferable that the transfer section 30 includes the belt conveyor 32 including the toothed belt 33, and the gear 34 that meshes with the teeth of the toothed belt 33.

In the case of transferring over a long distance, the media 100 can be transferred faster. Especially in the present embodiment, the printed medium storing container 70 is provided, and the long distance from the tray storing container 10 to the printed medium storing container 70 needs to be traveled. Since such a long distance travel can be performed at high speed, the printing can be performed in a shorter time.

In the printing device 1, the transfer section 30 includes the push-out section 31 that causes the tray 20 to move onto the table 50.

The tray 20 can be moved onto the table 50 more easily.

In the printing device 1, the contact pin 52 for restricting the moving distance in the transfer direction is provided at the downstream side in the transfer direction of the tray 20 by the push-out section 31.

By preventing positional displacement of the tray 20, the printing can be performed with even higher accuracy.

In the printing device 1, the transfer section 30 transfers the tray 20 on which the printed media 100 are mounted to the printed medium storing container 70 for storing the trays 20.

Since the media 100 are stored in the printed medium storing container 70, the user does not need to collect the printed media 100 by hand.

In the printing device 1, it is more preferable to include a post processing means that is at a position on the downstream side of the printing region R1 in the course of transfer by the transfer section 30, and that performs the post-print processing on the media 100.

For example, by being provided with a doming device for over-coating and/or spray gun as the post processing means, various post-print processing such as a doming step and/or a spray gun step can be performed on the media 100.

INDUSTRIAL APPLICABILITY

The present invention can, for example, be used suitably especially in the field of mass printing a plurality of products having a size relatively small compared to a head.

DESCRIPTION OF REFERENCE SIGNS LIST

1: Printing Device
10: Tray Storing Container (Recording Medium Installing Section)
20: Tray (Mounting Equipment)
30: Transfer Section (Transfer Means)
32: Belt Conveyor
33: Toothed Belt
34: Gear
40: Head
50: Table (Mounting Stand)
51: Optical Sensor
52: Contact Pin (Positioning section)
60: Acrylic Plate (Preprocessing Means)
70: Printed Medium Storing Container (Printed Recording Medium Storage)
100: Medium (Recording Medium)
R1: Printing Region
R2: Hand-over Region

The invention claimed is:

1. A printing device comprising:

a recording medium installing section that installs a plurality of mounting equipment on which recording media are mounted; and a transfer means that takes out one mounting equipment among the plurality of mounting equipment from the recording medium installing section, transfers the one mounting equipment to a printing region that faces a surface for discharging ink in a head for discharging the ink relative to a recording medium, and transfers the mounting equipment, on which a printed recording medium is mounted, to a printed recording medium storage that stores the mounting equipment, wherein the mounting equipment is mounted on a mounting stand which is disposed on the transfer means, wherein when the mounting equipment is transferred to the printing region which is disposed on a way of the transfer means, the recording media are arranged at a position suitable for printing by moving the mounting equipment up and down relative to the transfer means, and after printing, the recording media are returned to the transfer means and transferred again.

2. The printing device according to claim 1, further comprising:

a hand-over region that is at a position in a course of transfer from the recording medium installing section to the printing region by the transfer means, and that is a place to hand over the mounting equipment so as to mount the same on the mounting stand for mounting the mounting equipment.

3. The printing device according to claim 1, further comprising:

a preprocessing means that is at a position in the course of transfer from the recording medium installing section to the printing region by the transfer means, and that performs a pre-print processing on the recording medium.

4. The printing device according to claim 3, wherein the preprocessing means includes a vertical position adjusting section that adjusts a position of the recording medium in a vertical direction.

5. The printing device according to claim 3, further comprising:

a post processing means that is at a position on a downstream side of the printing region as transferred by the transfer means, and that performs a post-print processing on the recording medium.

6. The printing device according to claim 1, wherein the transfer means includes a toothed belt, and a gear that meshes with teeth of the toothed belt.

7. The printing device according to claim 6, wherein the transfer means further includes a mounting equipment moving section that moves the mounting equipment from inside to outside of the recording medium installing section.

8. The printing device according to claim 7, further comprising:

a positioning section that is on a downstream side in a transfer direction of the mounting equipment by the mounting equipment moving section, and that is for restricting a moving distance in the transfer direction.

9. The printing device according to claim 1, further comprising:

a post processing means that is at a position on a downstream side of the printing region as transferred by the transfer means, and that performs a post-print processing on the recording medium.

10. The printing device according to claim 1, wherein positions of upper surfaces of the recording media are detected by an optical sensor and the recording media are arranged at the position suitable for printing.

* * * * *